US009908536B2

(12) United States Patent
Sandheinrich et al.

(10) Patent No.: US 9,908,536 B2
(45) Date of Patent: Mar. 6, 2018

(54) HATCH COVER FOR RAILWAY CARS AND METHOD OF MANUFACTURING THE SAME

(71) Applicant: American Railcar Industries, Inc., St. Charles, MO (US)

(72) Inventors: Glenn Sandheinrich, Weldon Spring, MO (US); Christopher Reckker, O'Fallon, MO (US); Francisco J. Gonzalez, Cahokia, IL (US)

(73) Assignee: American Railcar Industries, Inc., St. Charles, MO (US)

( * ) Notice: Subject to any disclaimer, the term of this patent is extended or adjusted under 35 U.S.C. 154(b) by 54 days.

(21) Appl. No.: 15/040,562

(22) Filed: Feb. 10, 2016

(65) Prior Publication Data

US 2017/0225694 A1 Aug. 10, 2017

(51) Int. Cl.
*B61D 5/00* (2006.01)
*B65D 90/00* (2006.01)
*B61D 7/02* (2006.01)

(52) U.S. Cl.
CPC ..... *B61D 5/08* (2013.01); *B61D 7/02* (2013.01)

(58) Field of Classification Search
CPC ... B61D 5/06; B61D 5/00; B61D 5/08; B61D 7/00; B61D 7/16
See application file for complete search history.

(56) References Cited

U.S. PATENT DOCUMENTS 3,786,955 A * 1/1974 Mowatt-Larssen .... B65D 90/10 105/377.07
4,239,008 A * 12/1980 Conlon ..... B61D 39/00 105/247
4,840,126 A * 6/1989 Kleykamp ..... B61D 17/16 105/377.11
4,889,056 A * 12/1989 Stewart ..... B61D 5/08 105/377.11
5,355,808 A * 10/1994 Early ..... B61D 39/00 105/377.01
5,438,935 A * 8/1995 Seitz ..... F16J 13/18 105/377.11
6,085,664 A * 7/2000 Early ..... B61D 17/16 105/377.07
7,131,455 B2 * 11/2006 Horban ..... F17C 1/00 105/358
8,056,486 B2 * 11/2011 Haymond ..... B61D 39/00 105/377.07
8,584,597 B2 * 11/2013 DeLacerda ..... B61D 5/08 105/377.01
8,899,161 B2 * 12/2014 Douglas ..... B61D 5/08 105/377.07

(Continued)

*Primary Examiner* — Jason C Smith
(74) *Attorney, Agent, or Firm* — Armstrong Teasdale LLP

(57) ABSTRACT

A hatch cover for a covered hopper railcar includes a substantially circular shell member having a radially outer circumferential perimeter. The substantially circular shell member includes a topside surface and an underside surface. The hatch cover also includes a downwardly extending rim member coupled to and unitarily formed with the substantially circular shell member. The substantially circular shell member and the downwardly extending rim member define a shell/rim interface at the underside surface. The hatch cover further includes at least one sealing gasket fixedly coupled to the underside surface proximate the shell/rim interface.

20 Claims, 7 Drawing Sheets

(56) References Cited

U.S. PATENT DOCUMENTS

| | | | | |
|---|---|---|---|---|
| 2007/0024063 | A1* | 2/2007 | Silverio | B63C 11/02<br>292/256.5 |
| 2011/0107940 | A1* | 5/2011 | Borowski | B61D 5/08<br>105/377.05 |
| 2015/0083022 | A1* | 3/2015 | Douglas | B61D 5/08<br>105/377.07 |

* cited by examiner

HATCH COVER FOR RAILWAY CARS AND METHOD OF MANUFACTURING THE SAME

BACKGROUND

The field of the disclosure relates generally to railway cars and related components, and more particularly to a hatch cover for a covered hopper railcar and a method of manufacturing the same.

Railway cars have been used for many years to transport a wide variety of commodities. For example, covered hopper railcars transport solid flowable materials such as, for example, plastic pellets, coal, grains, and rock within hopper compartments therein. Many known covered hopper railcars include roof ports defined within a roof structure on the top of the covered railcars. Such roof ports facilitate gravity loading of the solid flowable materials as well as post-filling and post-unloading of such covered hopper railcars. In order to protect the solid flowable materials loaded in the covered hopper railcars from exposure to the elements and the introduction of foreign materials, each of the roof ports are typically covered with a known hatch cover.

Many known hatch covers include at least one hold down strap (sometimes referred to as a support bar, compression member, or securement strap) with a hinging device on one end and a latching device on the opposite end. These hold down straps are typically fabricated of metal and require additional production costs to manufacture and install. In addition, at least some known hold down straps are coupled to the associated hatch covers through fasteners that require fastener penetrations in the hatch covers, thereby potentially forming a potential leak path for gases, such as an outward flow of inert nitrogen, used to provide a protective environment for those solid flowable materials that may be sensitive to oxygen and/or moisture found in air that may flow into the railcar. In addition, some known hatch covers do not include sealing gaskets, thereby decreasing the ability of the hatch covers to properly seal the inside of the hopper compartments. Also, some other known hatch covers include a sealing gasket arrangement as part of a complicated configuration, thereby increasing production costs to manufacture and install.

BRIEF DESCRIPTION

In one aspect, a hatch cover for a covered hopper railcar is provided. The hatch cover includes a substantially circular shell member having a radially outer circumferential perimeter. The substantially circular shell member includes a topside surface and an underside surface. The hatch cover also includes a downwardly extending rim member coupled to and unitarily formed with the substantially circular shell member. The substantially circular shell member and the downwardly extending rim member define a shell/rim interface at the underside surface. The hatch cover further includes at least one sealing gasket fixedly coupled to the underside surface proximate the shell/rim interface.

In another aspect, a covered hopper railcar is provided. The covered hopper railcar includes a roof assembly defining at least one substantially circular hatch port and at least partially defining at least one hopper compartment coupled in flow communication with the at least one substantially circular hatch port. The covered hopper railcar also includes a hatch cover configured to extend over the at least one substantially circular port. The hatch cover includes a substantially circular shell member having a radially outer circumferential perimeter. The substantially circular shell member includes a topside surface and an underside surface. The hatch cover also includes a downwardly extending rim member coupled to and unitarily formed with the substantially circular shell member. The substantially circular shell member and the downwardly extending rim member define a shell/rim interface at the underside surface. The hatch cover further includes at least one sealing gasket fixedly coupled to the underside surface proximate the shell/rim interface.

In another aspect, a method of assembling a covered hopper railcar is provided. The method includes manufacturing a roof assembly including at least partially defining at least one hopper compartment and forming at least one substantially circular hatch port coupled in flow communication with the at least one hopper compartment. The method also includes fabricating a hatch cover configured to extend over the at least one substantially circular port. Fabricating the hatch cover includes unitarily forming a substantially circular shell member and a downwardly extending rim member coupled thereto. The substantially circular shell member has a radially outer circumferential perimeter. The substantially circular shell member includes a topside surface and an underside surface. The substantially circular shell member and the downwardly extending rim member define a shell/rim interface at the underside surface. The method further includes fixedly coupling at least one sealing gasket to the underside surface proximate the shell/rim interface.

DRAWINGS

FIG. 1 is a side view of a railway car.

FIG. 2 is an overhead view of the railway car shown in FIG. 1.

FIG. 3 is a perspective view of an example hatch cover that may be used with the railway car shown in FIGS. 1 and 2.

FIG. 4 is an overhead schematic view of the hatch cover shown in FIG. 3.

FIG. 5 is a schematic view of an example pair of hinge lugs that may be used with the hatch cover shown in FIGS. 3 and 4.

FIG. 6 is a schematic side view of the hinge lugs shown in FIG. 5.

FIG. 7 is a schematic view of an example latch lug that may be used with the hatch cover shown in FIGS. 3 and 4.

FIG. 8 is a schematic side view of the latch lug shown in FIG. 7.

FIG. 9 is a schematic cutaway view of the hatch cover shown in FIGS. 3 and 4, taken along line 9-9 shown in FIG. 4.

FIG. 10 is a schematic view of an example underside surface of the hatch cover shown in FIG. 9 and an example gasket coupled thereto.

DETAILED DESCRIPTION

The example methods, devices, and railcars described herein overcome at least some disadvantages of known covered hopper railcars by eliminating the hold down straps from the associated hatch covers. Such elimination of the hold down straps reduces the costs associated with manufacturing the hatch covers and assembling the covered hopper railcars through a reduction of the materials used and decreasing the weight of the hatch covers. In addition, elimination of the fastener penetrations for the hold down straps reduces a potential for fluid communication between the hopper compartment of the railcar and the outside environment. Moreover, directly coupling the hinge lugs and the latching tab lugs to the hatch cover through depositing intermittent weld beads facilitates ease of placing the hatch covers on the railcar. Furthermore, coupling a sealing gasket to the inner surface of the hatch cover using an adhesive facilitates effectively sealing the associated port at low cost.

Figure 1:
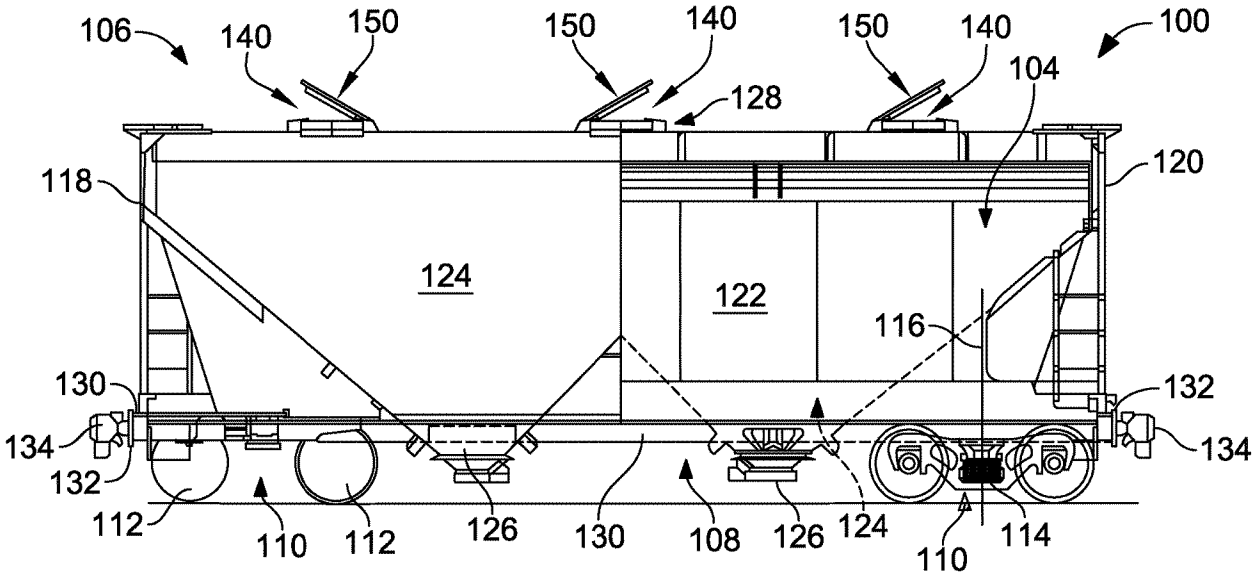
FIG. 1-10 show exemplary embodiments of the apparatus and methods described herein.
Figure 2:
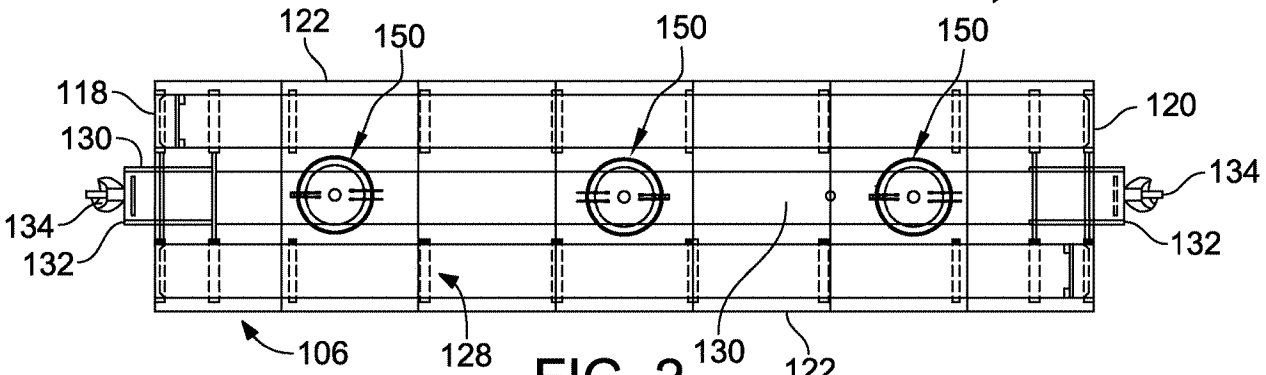

FIG. 1 is a side view of a railway car 100 and a sill assembly 102 coupled to railway car 100. FIG. 2 is an overhead view of railway car 100. In the exemplary embodiment, railway car 100 is a closed-top railway hopper car. Railway car 100 can be used to store and/or transport materials or commodities, such as, without limitation, dried distillers' grains, dried distillers' grains with solubles, coal, and/or any other suitable granular and/or flowable commodity material.

Railway car 100 includes a material transport portion 104 having an upper portion 106 that is attached to a lower portion 108. Lower portion 108 also includes a pair of truck assemblies 110, which includes a pair of axles (not shown) that are coupled to a pair of wheel sets 112. Each truck assembly 110 also includes a bolster 114 that defines a bolster centerline 116. In the exemplary embodiment, upper portion 106 includes a front end structure 118, a rear end structure 120, and two opposing sidewalls 122 extending there between, thereby at least partially defining a plurality of cargo cavities, i.e., hopper compartments 124. Each hopper compartment 124 has at least one associated discharge gate 126 hingedly coupled to a portion of lower portion 108. A roof assembly 128 is coupled to, and extends among, front end structure 118, rear end structure 120, and opposing sidewalls 122 and extends over hopper compartments 124. In the exemplary embodiment, a sill assembly 130 is coupled to railway car 100. More particularly, sill assembly 130 is coupled to lower portion 108 and extends between front end structure 118 and rear end structure 120. Moreover, railway car 100 includes a striker assembly 132 coupled to each end of sill assembly 130 and a coupling mechanism 134 coupled to each striker assembly 132. Roof assembly 128 includes a plurality of ports 140 for access to hopper components 124. Each port 140 receives a hatch cover 150 that extends over the associated port 140.

Figure 3:
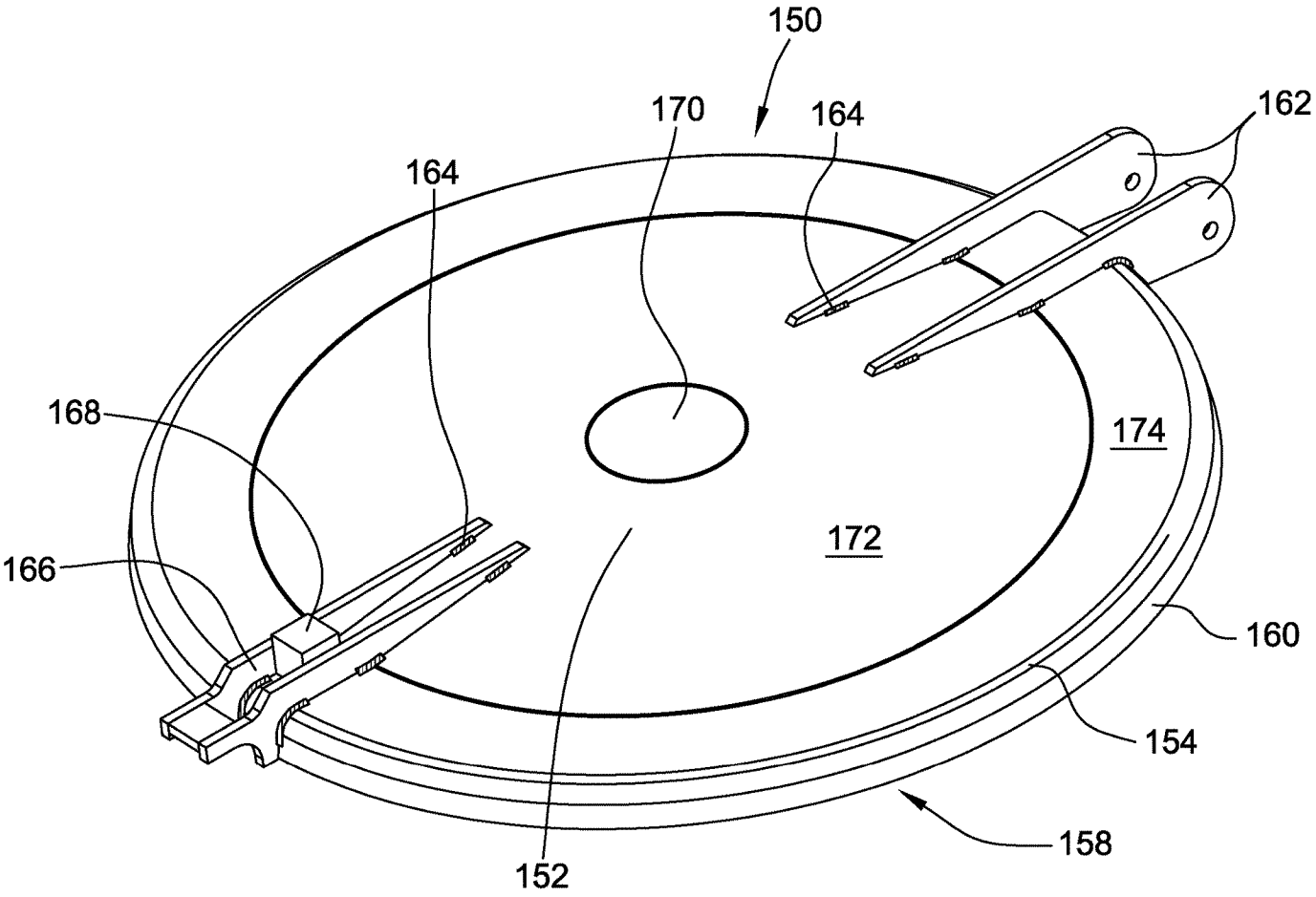
Figure 4:
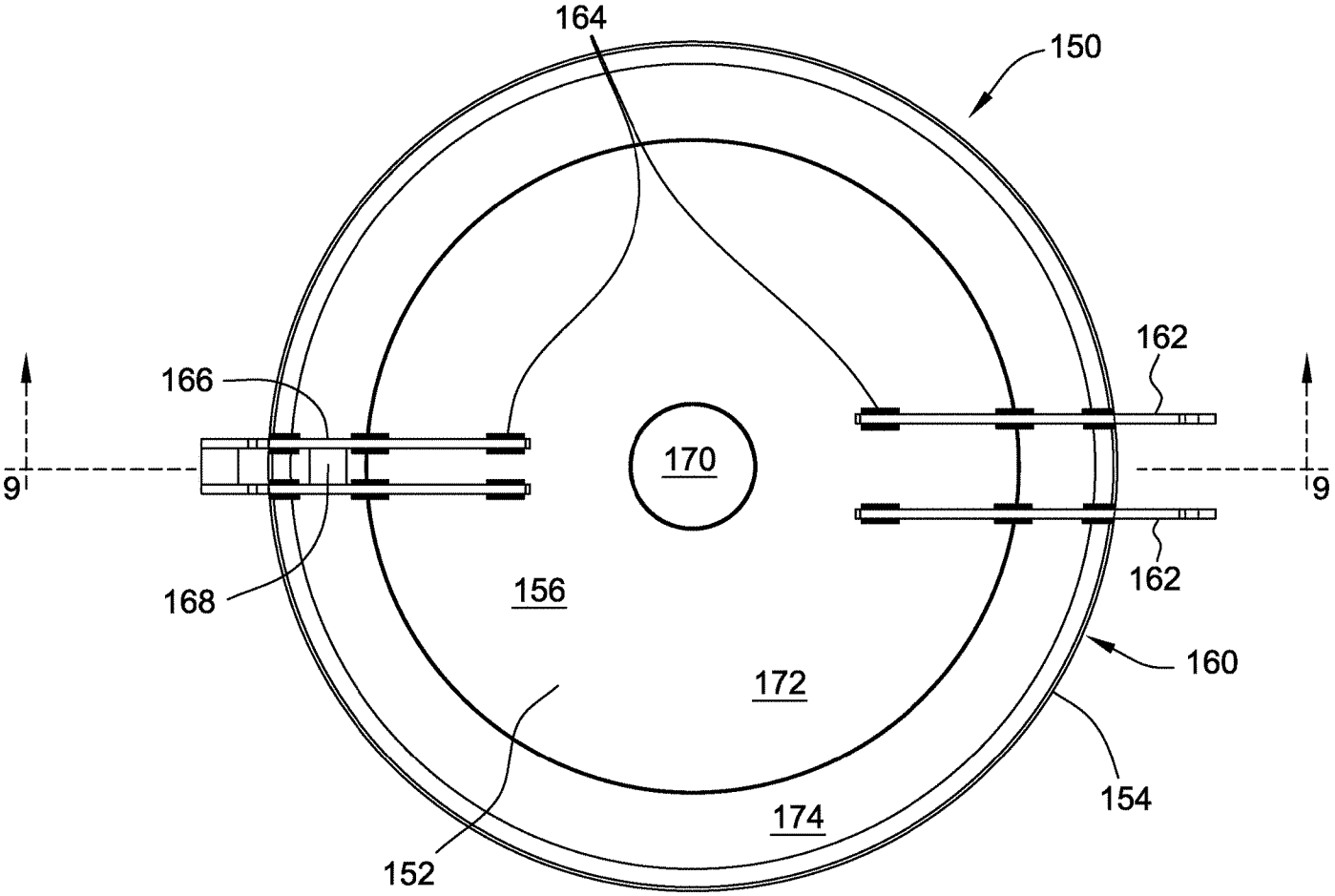

FIG. 3 is a perspective view of an example hatch cover 150 that may be used with railway car 100 (shown in FIGS. 1 and 2). FIG. 4 is an overhead schematic view of hatch cover 150. Hatch cover 150 is devoid of hold down straps and associated hollow bolts. Hatch cover 150 includes a substantially circular shell member 152 having a radially outer circumferential perimeter 154. Shell member 152 includes a topside surface 156 and an underside surface 158. Topside surface 156 and underside surface 158 define a substantially inwardly concave (outwardly convex) and substantially ellipsoidal shape. Hatch cover 150 also includes a downwardly extending rim member 160 coupled to and unitarily formed with substantially circular shell member 152. Substantially circular shell member 152 and downwardly extending rim member 160 are substantially devoid of penetrations therethrough.

Moreover, in the example embodiment, hatch cover 150 includes at least one hinge lug 162 (two shown) welded to substantially circular shell member 152 through a plurality of intermittent weld beads 164 at predetermined positions. Similarly, hatch cover 150 includes at least one latch lug 166 (one shown) welded to substantially circular shell member 152 through plurality of intermittent weld beads 164 at predetermined positions. In alternative embodiments, hinge lugs 162 and latching lug 166 are coupled to hatch cover 150 through one of adhesives and unitary fabrication.

A bumper 168 is positioned proximate latch lug 166. Substantially circular shell member 152 and topside surface 156 define a center substantially horizontal portion 170, an intermediate sloped portion 172, and a radially outer substantially horizontal portion 174 to which downwardly extending rim member 160 is coupled. Hatch cover 150 is unitarily formed through pressing, where hatch cover 150 is fabricated with one of aluminum, carbon steel, and plastic. Alternatively, any lightweight, yet sturdy and robust material is used.

Figure 5:
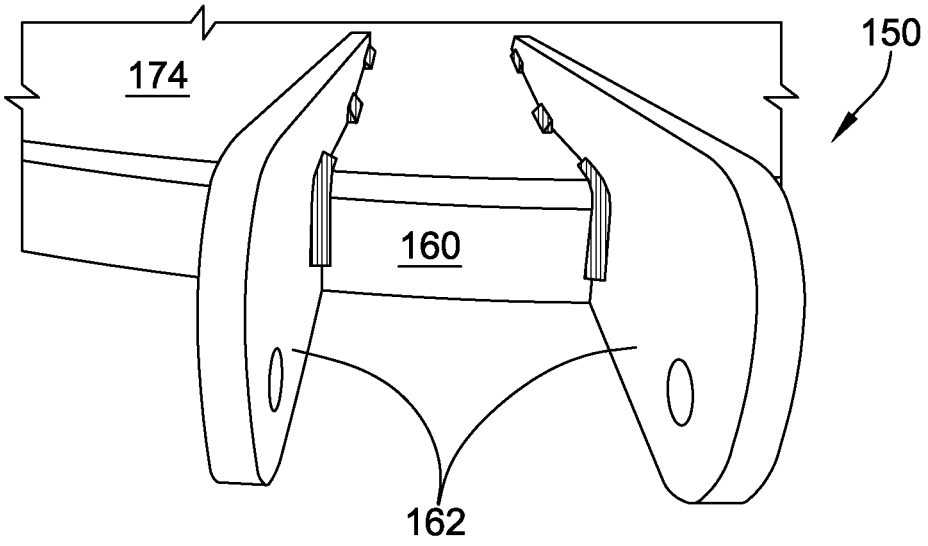
Figure 6:
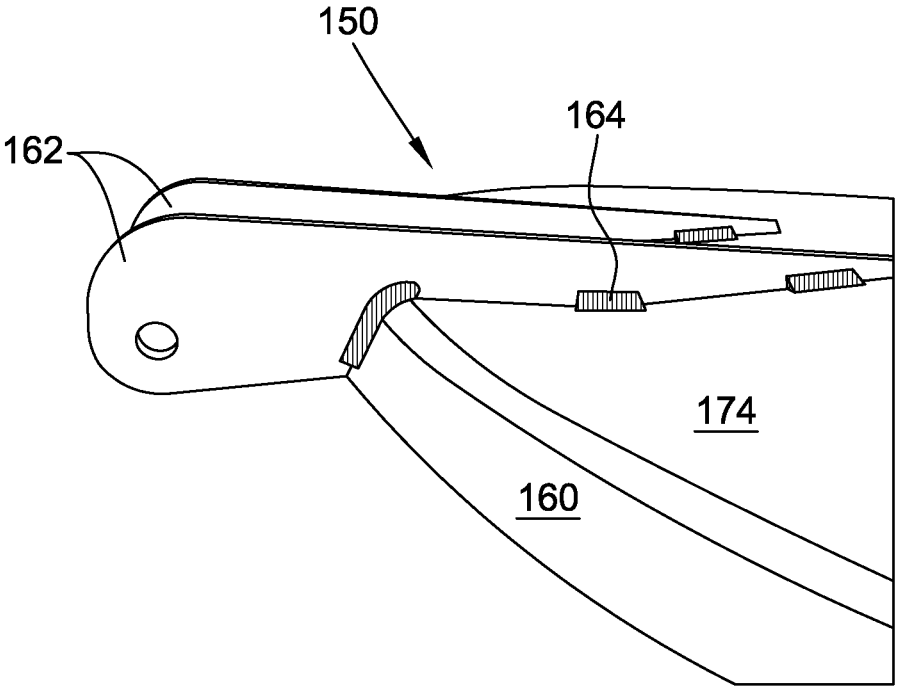
Figure 7:
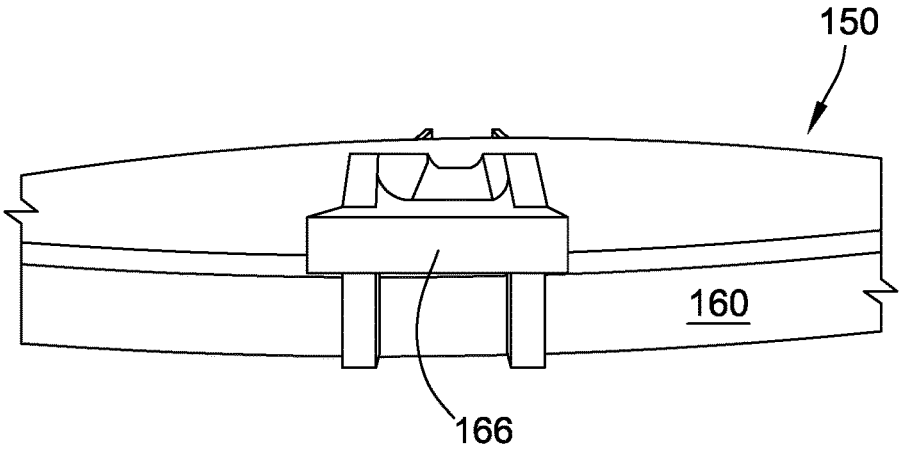
Figure 8:
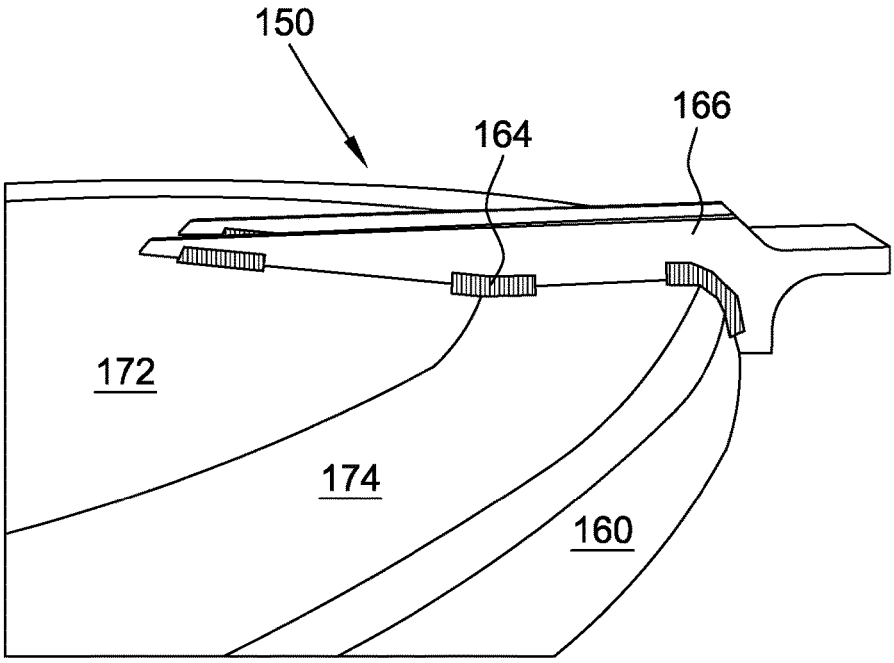

FIG. 5 is a schematic view of hinge lugs 162 and FIG. 6 is a schematic side view of hinge lugs 162. FIG. 7 is a schematic view of latch lug 166 and FIG. 8 is a schematic side view of latch lug 166.

Figure 9:
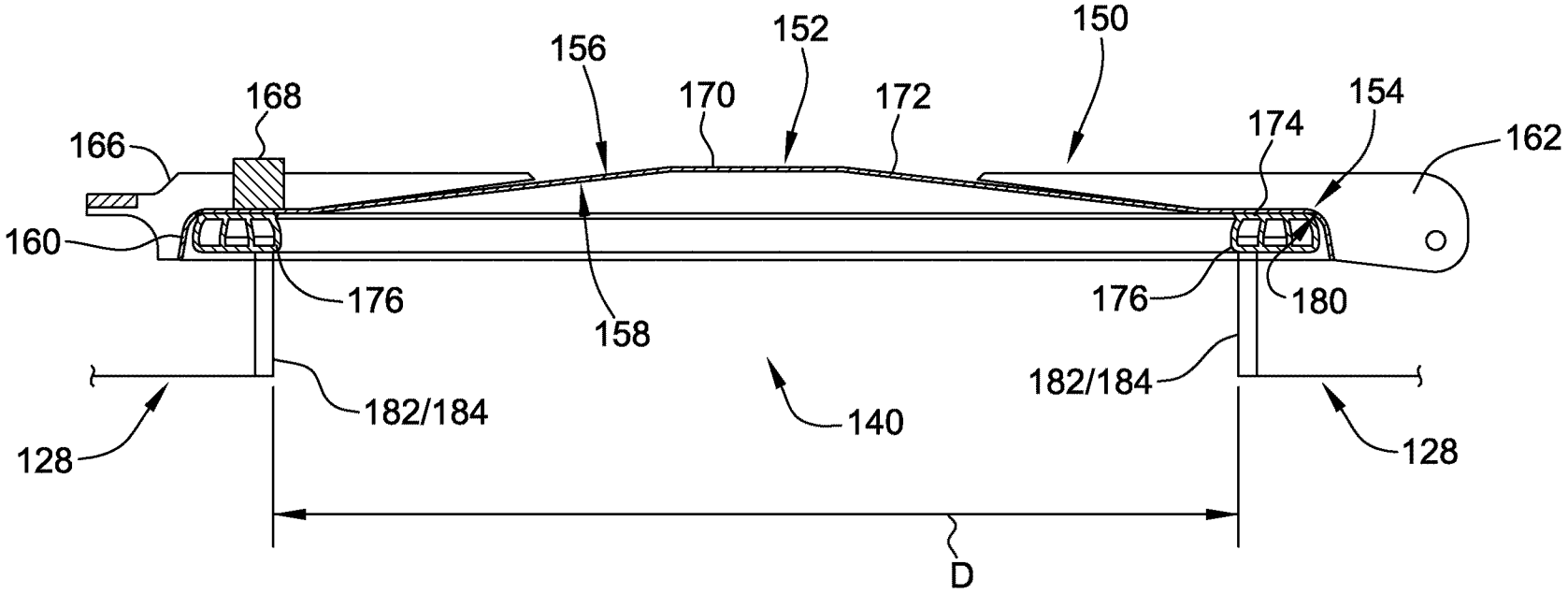
Figure 10:
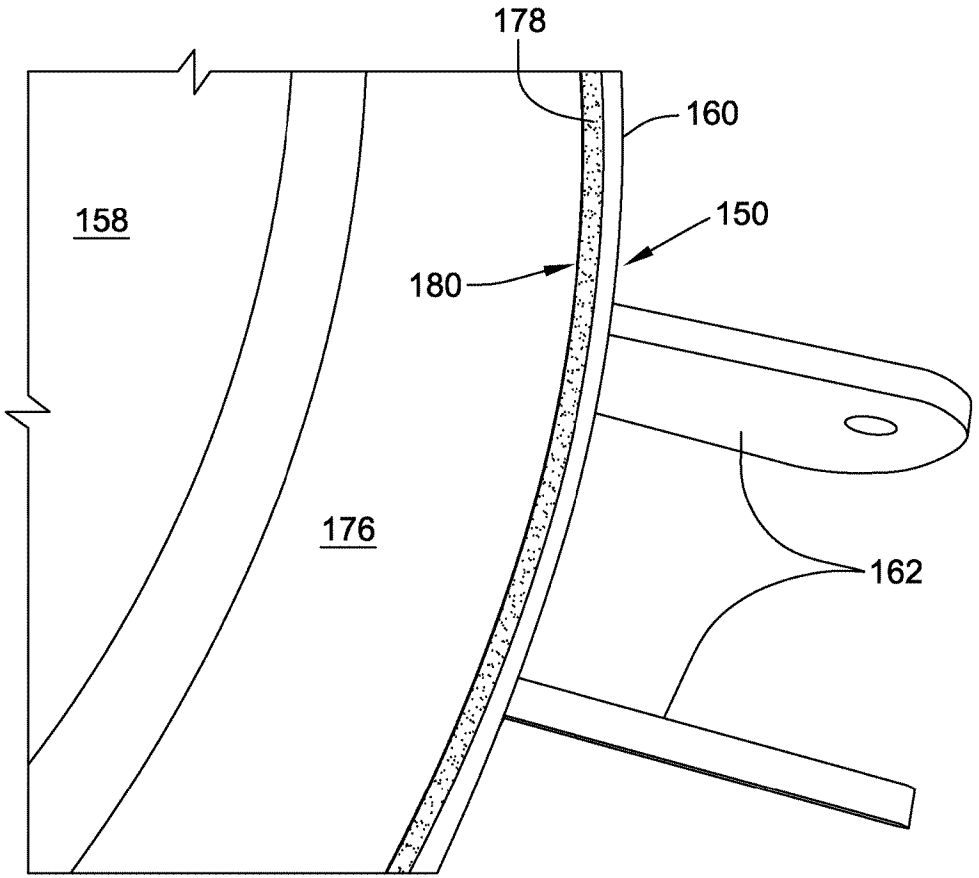

FIG. 9 is a schematic cutaway view of hatch cover 150 taken along line 9-9 (shown in FIG. 4). FIG. 10 is a schematic view of underside surface 158 and at least one sealing gasket 176 (only one shown) fixedly coupled thereto with an adhesive 178 proximate a shell/rim interface 180 defined by substantially circular shell member 152 and downwardly extending rim member 160. Sealing gasket 176 is fabricated from one of foam and rubber. Roof assembly 128 of covered hopper railcar 100 (both shown in FIGS. 1 and 2) includes at least one hatch wall 182 (only one shown in FIG. 9) extending substantially downward toward hopper compartment 124 (shown in FIG. 1). Hatch wall 182 includes a substantially cylindrical inner surface 184, where hatch wall 182 defines substantially circular hatch port 140 having an inner diameter D of approximately 30 inches. Alternatively, diameter D is any value that enables operation of railcar 100 as described herein.

The above described example methods, devices, and railcars overcome at least some disadvantages of known covered hopper railcars by eliminating the hold down straps from the associated hatch covers. Such elimination of the hold down straps reduces the costs associated with manufacturing the hatch covers and assembling the covered hopper railcars through a reduction of the materials used and decreasing the weight of the hatch covers. In addition, elimination of the fastener penetrations for the hold down straps reduces a potential for fluid communication between the hopper compartment of the railcar and the outside environment. Moreover, directly coupling the hinge lugs and the latching tab lugs to the hatch cover through depositing intermittent weld beads facilitates ease of placing the hatch covers on the railcar. Furthermore, coupling a sealing gasket to the inner surface of the hatch cover using an adhesive facilitates effectively sealing the associated port at low cost.

Example embodiments of hatch covers for covered hopper railcars and method of manufacturing the same are described above in detail. The hatch covers and methods are not limited to the specific embodiments described herein, but rather, components of apparatus and/or steps of the method may be utilized independently and separately from other components and/or steps described herein. For example, the hatch covers may also be used in combination with other types of railcar, and are not limited to practice with only the railcars as described herein.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A hatch cover for a covered hopper railcar, said hatch cover comprising:

a substantially circular shell member having a radially outer circumferential perimeter, said substantially circular shell member comprising a topside surface and an underside surface;

a downwardly extending rim member coupled to and unitarily formed as one piece with said substantially circular shell member, said substantially circular shell member and said downwardly extending rim member define a shell/rim interface at said underside surface; and at least one sealing gasket fixedly coupled to said underside surface proximate said shell/rim interface.

2. The hatch cover in accordance with claim 1, wherein said substantially circular shell member and said downwardly extending rim member are substantially devoid of penetrations therethrough.

3. The hatch cover in accordance with claim 1 further comprising at least one hinge lug welded to said substantially circular shell member, wherein said at least one welded hinge lug comprises a plurality of intermittent weld beads at predetermined positions.

4. The hatch cover in accordance with claim 1 further comprising at least one latch lug welded to said substantially circular shell member, wherein said at least one welded latch lug comprises a plurality of intermittent weld beads at predetermined positions.

5. The hatch cover in accordance with claim 1, wherein said substantially circular shell member is substantially inwardly concave and substantially ellipsoidal.

6. The hatch cover in accordance with claim 1, wherein said hatch cover is devoid of hold down straps.

7. The hatch cover in accordance with claim 1, wherein said hatch cover is fabricated with aluminum.

8. A covered hopper railcar comprising:

a roof assembly defining at least one substantially circular hatch port and at least partially defining at least one hopper compartment coupled in flow communication with said at least one substantially circular hatch port; and a hatch cover configured to extend over said at least one substantially circular port, said hatch cover comprising:

a substantially circular shell member having a radially outer circumferential perimeter, said substantially circular shell member comprising a topside surface and an underside surface;

a downwardly extending rim member coupled to and unitarily formed as one piece with said substantially circular shell member, said substantially circular shell member and said downwardly extending rim member define a shell/rim interface at said underside surface; and at least one sealing gasket fixedly coupled to said underside surface proximate said shell/rim interface.

9. The covered hopper railcar in accordance with claim 8, wherein said substantially circular shell member and said downwardly extending rim member are substantially devoid of penetrations therethrough.

10. The covered hopper railcar in accordance with claim 8 further comprising at least one hinge lug welded to said substantially circular shell member, wherein said at least one welded hinge lug comprises a plurality of intermittent weld beads at predetermined positions.

11. The covered hopper railcar in accordance with claim 8 further comprising at least one latch lug welded to said substantially circular shell member, wherein said at least one welded latch lug comprises a plurality of intermittent weld beads at predetermined positions.

12. The covered hopper railcar in accordance with claim 8, wherein said substantially circular shell member is substantially inwardly concave and substantially ellipsoidal.

13. The covered hopper railcar in accordance with claim 8, wherein said hatch cover is devoid of hold down straps.

14. The covered hopper railcar in accordance with claim 8, wherein said hatch cover is fabricated with aluminum.

15. The covered hopper railcar in accordance with claim 8, wherein said roof assembly comprises at least one hatch wall extending substantially downward toward said at least one hopper compartment, said at least one hatch wall comprising a substantially cylindrical inner surface, wherein said at least one hatch wall defines said at least one substantially circular hatch port, said at least one substantially circular hatch port having an inner diameter of approximately 30 inches.

16. A method of assembling a covered hopper railcar, said method comprising:

manufacturing a roof assembly comprising:

at least partially defining at least one hopper compartment; and forming at least one substantially circular hatch port coupled in flow communication with the at least one hopper compartment; and fabricating a hatch cover configured to extend over the at least one substantially circular port, said fabricating the hatch cover comprising:

unitarily forming as one piece a substantially circular shell member and a downwardly extending rim member coupled thereto, the substantially circular shell member having a radially outer circumferential perimeter, the substantially circular shell member including a topside surface and an underside surface, the substantially circular shell member and the downwardly extending rim member defining a shell/rim interface at the underside surface; and fixedly coupling at least one sealing gasket to the underside surface proximate the shell/rim interface.

17. The method in accordance with claim 16 further comprising welding at least one hinge lug to the substantially circular shell member comprising depositing a plurality of intermittent weld beads at predetermined positions.

18. The method in accordance with claim 16 further comprising welding at least one latch lug to the substantially circular shell member comprising depositing a plurality of intermittent weld beads at predetermined positions.

19. The method in accordance with claim 16, wherein forming at least one substantially circular hatch port comprises forming the substantially circular shell member with a substantially inwardly concave and substantially ellipsoidal shape.

20. The method in accordance with claim 16, wherein forming at least one substantially circular hatch port comprises fabricating at least one hatch wall extending substantially downward toward the at least one hopper compartment, the at least one hatch wall including a substantially cylindrical inner surface, wherein the at least one hatch wall defines the at least one substantially circular hatch port, the at least one substantially circular hatch port having an inner diameter of approximately 30 inches.

* * * * *